US005950522A

United States Patent [19]

Balfour

[11] Patent Number: 5,950,522

[45] Date of Patent: Sep. 14, 1999

[54] ROTARY PUMP AND CAM RING THEREFOR

[75] Inventor: Graham Paul Boyd Balfour, Hampton, United Kingdom

[73] Assignee: Lucas Industries PLC, Solihull, United Kingdom

[21] Appl. No.: 08/868,633

[22] Filed: Jun. 2, 1997

[30] Foreign Application Priority Data

Jun. 4, 1996 [GB] United Kingdom ..... 9611588

[51] Int. Cl.[6] ..... F01B 1/06

[52] U.S. Cl. ..... 92/72; 91/491

[58] Field of Search ..... 92/12.1, 58, 72, 92/148; 91/491

[56] References Cited

U.S. PATENT DOCUMENTS

| | | | |
|---|---|---|---|
| 3,949,647 | 4/1976 | Martin | 91/491 X |
| 4,132,154 | 1/1979 | Nishiba | 91/491 |
| 4,157,056 | 6/1979 | Allart et al. | 91/491 |
| 4,256,018 | 3/1981 | Badoureaux et al. | 91/491 X |

FOREIGN PATENT DOCUMENTS

| | | |
|---|---|---|
| 202451 | 4/1986 | European Pat. Off. . |
| 2099948 | 4/1982 | United Kingdom . |
| 2290835 | 1/1996 | United Kingdom . |

*Primary Examiner*—John E. Ryznic
*Attorney, Agent, or Firm*—Sheridan Ross P.C.

[57] ABSTRACT

A rotary pump such as a rotary fuel injection pump comprises a pump body; a rotor rotatably supported by the pump body and responsive to mechanical pulses to pump a fluid; and a stator ring (208) supported by the pump body and having a ring of projections (209) arranged to deliver mechanical pulses to the rotor when the rotor rotates relative to the stator ring. The stator ring (208) has a vibrational mode which is induced by delivering the mechanical pulses to the rotor. The pump body supports the stator ring across an interface which is a complete annulus or a partial annulus. In order to reduce the transmission of vibration from the stator ring to the pump body, the interface and/or stator ring incorporate cavities at the antinodes of the vibrational mode of the stator ring.

21 Claims, 4 Drawing Sheets

ROTARY PUMP AND CAM RING THEREFOR

FIELD OF THE INVENTION

This invention relates to a rotary pump and in particular the interface between a pump body and a stator ring of the rotary pump. The invention also relates to a cam ring for a rotary pump.

BACKGROUND OF THE INVENTION

A known rotary pump is a rotary fuel injection pump for a diesel engine. A typical rotary fuel injection pump is the Lucas distributor-type pump or the Bosch VE-type pump. These pumps are mounted on and driven by an engine so as to pump fuel from a fuel tank to the fuel injectors of the engine.

The pumping unit comprising the pumping components at the core of a Lucas distributor-type pump is illustrated in FIGS. 1 and 2.

A rotor 1 is connected to and driven by a drive shaft which is driven at half engine speed. The rotor 1 comprises a rotor shaft 2 which is integral with a rotor disc 3. A pair of diametrically opposed pump plungers 4 are mounted in the rotor disc 3 so as to be slidable in and out along a diameter of the rotor disc in order to act on a central pump chamber 5. Rollers 6 mounted in bearing blocks 7 are used to compress together the pump plungers 4. A cam ring 8 is disposed around the rotor disc 3 and has an annular inner surface which faces radially inwards and includes a ring of radially inwardly projecting cam lobes 9. The rotor 1 is coaxial with the cam ring 8 so that, as the rotor rotates relative to the cam ring, the rollers 6 roll around the annular inner surface of the cam ring 8 and receive mechanical pulses as they pass over the cam lobes 9. These mechanical pulses move the pump plungers 4 radially inwards towards one another so as to reduce the volume of the pump chamber 5 and thereby compress the fluid in the pump chamber 5.

The pump body includes a stationary hydraulic head 10 which is annular and surrounds the rotor shaft 2 of the rotor 1. There is a single metering port 11 in the hydraulic head 10 and it acts as a fuel inlet. Further along the hydraulic head are six outlet ports 12 regularly spaced apart at 60° intervals around the hydraulic head. Only five of the outlet ports 12 are visible in FIGS. 1 and 2. The other outlet port is hidden behind the rotor shaft 2. There are six outlet ports 12 because the rotary pump is arranged to supply the six fuel injectors of a six-cylinder engine. For an engine with a different number of cylinders, the number of outlet ports would be increased or decreased accordingly.

A central duct 13 extends from the pump chamber 5 of the rotor disc 3 along the central axis of the rotor shaft 2 and terminates at a distributor port 14. As the rotor rotates, the distributor port 14 comes successively into alignment with the outlet ports 12. Midway along the central duct 13 are six charging ports 15. As the rotor rotates, the metering port 11 in the hydraulic head 10 successively becomes aligned with the charging ports 15 in the rotor shaft 2.

The arrangement in FIG. 1 permits the pump chamber 5 to be filled with fuel. The metering port 11 is aligned with one of the charging ports 15 and the distributor port 14 is not aligned with any of the outlet ports 12. Consequently, fuel which has already been raised slightly in pressure by a transfer pump of the rotary pump enters the metering port 11 and passes via the aligned charging port 15 to the central duct 13. The fuel passes along the central duct 13 and into the pump chamber 5. Because of the relative rotational positions of the rotor 1 and the cam ring 8, the rollers 6 are, at the moment in question, located in troughs between the cam lobes 9. Consequently, the fuel entering the pump chamber 5 is able to push apart the pump plungers 4 so as to permit the pump chamber to be filled with fuel.

The drive shaft then rotates the rotor 1 from the position shown in FIG. 1 to the position shown in FIG. 2. During the course of this movement, the metering port 11 is isolated from the charging ports 15 and the distributor port 14 is brought into alignment with one of the outlet ports 12. Also, the rollers 6 ride up to the tops of two of the cam lobes 9 and, consequently, the cam lobes deliver mechanical pulses to the rollers 6. These mechanical pulses are converted via the bearing blocks 7 and the pump plungers 4 into pressure pulses acting on the fuel in the pump chamber 5. These pressure pulses rapidly raise the pressure of the fuel and the thus-pressurised fuel is able to pass along the central duct 13, along the distributor port 14 and out of the particular outlet port 12 which is aligned with the distributor port 14. This fuel, now at a high pressure, is then supplied to one of the fuel injectors of the engine.

This whole pumping cycle is repeated once for each engine cylinder per pump revolution.

Although not illustrated, the cam ring 8 is received in an aperture of the pump body and is rotationally adjustable through a small angle in order to be able to advance and retard the pumping action. A typical advance and retard mechanism is illustrated in EP-0,438,892.

FIG. 3 is a cross-section through a known cam ring suitable for use in a Lucas distributor-type pump. The cam ring 108 is for use with a four-cylinder engine and thus has only four cam lobes 109. Undesirable noise is produced by vibration of the cam ring 108. In use, the cam lobes 109 deliver mechanical pulses to the rollers of the associated rotor. Reaction forces are generated back on to the cam lobes 109 by the rollers and the cam ring 108 starts to vibrate in a fundamental ring mode with four nodes. This mode involves radial vibration of the cam ring and is illustrated diagrammatically in FIG. 3. For the particular illustrated cam ring with its mass and stiffness distribution, the nodes N are located at the troughs between the cam lobes 109 and involve a comparatively small amount of radial vibration. The antinodes AN are located at the cam lobes 9 and involve a relatively large amount of radial vibration. The vibration can be excited by the impact of the rollers in over-the-nose type pumping or by the rapid collapse of fuel pressure in the pump chamber in spill-type pumping.

It is typically the case that the annular outer surface 116 of the cam ring 108 is circular along a typical length C of its periphery. The remaining length (length D) of the outer surface 116 may incorporate localised flat portions in order to interface with an adjustment mechanism used to impart some rotational adjustment to the cam ring in order to advance and retard the pumping action. The reader is referred to EP-0,438,892 for an illustration of the type of localised flat surfaces that may be incorporated along length D of the annular outer surface 116.

The lengths of the double-headed arrows illustrating nodes N and antinodes AN are not intended to be accurate representations of the absolute magnitudes of the vibration but, instead, are intended to illustrate the fact that the vibrational magnitude at the antinodes AN is greater than the vibrational magnitude at the nodes N.

The cam ring 108 is received in a circular aperture in the pump body. The circular aperture is interrupted by a slot at a location corresponding to the length D of the outer surface 116 in order to accommodate the adjustment mechanism which is connected to the bottom of the cam ring. The length C of the outer surface 116 forms an interface with the circular side wall of the aperture of the pump body. This interface is a partial annulus. Such a partial annulus is illustrated in EP-0,438,892. In relation to the cam ring 108 of FIG. 3, four of the antinodes AN are believed to transmit their vibration across the interface, thereby producing unwanted noise from the rotary pump.

SUMMARY OF THE INVENTION

According to the first aspect of the present invention, there is provided a rotary pump comprising a pump body; a rotor rotatably supported by the pump body and responsive to mechanical pulses to pump a fluid; and a stator ring supported by the pump body and having a ring of projections arranged to deliver mechanical pulses to the rotor when the rotor rotates relative to the stator ring; wherein the stator ring has a vibrational mode which is induced by delivering the mechanical pulses to the rotor; the pump body supports the stator ring across an interface which is a complete annulus or a partial annulus; and at the interface, and/or in the stator ring, there are cavities positioned at the antinodes of the vibrational mode of the stator ring so as to reduce the vibrational transmission from the stator ring to the pump body across the interface.

Because the vibrational coupling from the stator ring to the pump body is reduced, the noise produced by the pump is reduced.

Usually, the cavities will be empty of any solid material. This is the preferred arrangement, but it may be possible in some embodiments to have vibration-deadening material contained in the cavities which serves to deaden the vibration of the stator ring at the antinodes. Such material would be less rigid than the material (e.g. metal) of the pump body and the stator ring.

In some embodiments the interface comprises a first surface of the stator ring, the first surface lying on a notional interface circle, and a second surface of the pump body, the second surface having along its length a series of peaks and a series of depressions located between the peaks; and the peaks lie on the notional interface circle so as to abut the first surface, whereby the pump body supports the stator ring, and the depressions extend away from the notional interface circle so as to form the cavities at the interface.

In other embodiments, the interface comprises a first surface of the stator ring and a second surface of the pump body; the second surface lies on a notional interface circle; the first surface has along its length a series of peaks and a series of depressions located between the peaks; and the peaks lie on the notional interface circle so as to abut the second surface, whereby the stator ring is supported by the pump body, and the depressions extend away from the notional interface circle so as to form the cavities at the interface.

In yet further embodiments, the stator ring comprises inner and outer component rings which are rigidly fixed together and the cavities are formed as gaps in the annular joint between the component rings.

In many stator rings, the mass and stiffness distribution around the stator ring will be such that the antinodes of the vibrational mode are positioned, circumferentially of the stator ring, at the projections of the stator ring, in which case the cavities should be positioned at the same circumferential positions as the projections.

Preferably, the stator ring is a cam ring which has an annular inner surface which faces radially inwards and includes a series of cam lobes which function as the ring of projections for delivering the mechanical pulses to the rotor when the rotor rotates relative to the cam ring. By producing the depressions in the stator ring (e.g. the cam ring of a Lucas distributor-type pump), the invention may be applied to existing rotary pumps merely by fitting them with a new stator ring incorporating the required depressions.

If the invention is to be applied to a Lucas distributor-type pump and if the vibration-transmission minimising features are to be provided on the stator ring, the first surface of the stator ring is part or all of the length of an annular outer surface of the cam ring; the annular outer surface faces radially outwards; and the depressions of the first surface are radially aligned with the cam lobes.

Preferably, each peak has a curved top which has the same curvature as the notional interface circle. In this way, the depressions may simply be machined out from or otherwise formed in a conventional stator ring in order to produce the stator ring suited to the invention.

In some embodiments, the pump body has an aperture in which the stator ring is received and is rotationally adjustable; the aperture defines the second surface and is interrupted by a slot which contains an adjustment mechanism for rotationally adjusting the stator ring in the aperture; and the adjustment mechanism is connected to the stator ring at one of the nodes of the vibrational mode of the stator ring.

If the invention is to be applied to a Bosch VE-type pump, the stator ring comprises a roller ring which has an end which includes a series of axially-projecting rollers which function as the ring of projections for delivering the mechanical pulses to a cam plate of the rotor when the rotor rotates relative to the roller ring.

According to a second aspect of the present invention, there is provided a cam ring for a rotary pump, wherein: the cam ring has an annular inner surface which faces radially inwards and includes a ring of cam lobes for driving pump plungers of a pump rotor; the cam ring has an annular outer surface which faces radially outwards and has, along part or all of its length, a series of peaks and a series of depressions located between the peaks; and each depression is radially aligned with a respective one of the cam lobes.

Preferably, each peak has a curved top which lies on a notional circle common to all of the curved tops of the peaks and has the same curvature as the notional circle.

Usually, there are "n" peaks and at least "n−1" depressions and more usually "n" depressions, "n" is an integer greater than or equal to three and each depression is located between a respective successive pair of the peaks. In many embodiments "n" is 3, 4, 5, 6 or 8.

According to a third aspect of the present invention, there is provided a cam ring for a rotary pump, wherein: the cam ring comprises inner and outer component rings which are rigidly fixed together; the inner component ring has an annular inner surface which faces radially inwards and includes a ring of cam lobes for driving pump plungers of a pump rotor; and there are cavities in the annular joint between the component rings.

It is expected that, for typical mass and stiffness distributions around the stator ring, it will usually be the case that each cavity is radially aligned with a respective one of the cam lobes.

Non-limiting embodiments of the present invention will now be described with reference to the accompanying drawings, in which:

DETAILED DESCRIPTION OF THE PREFERRED EMBODIMENTS

Figure 1:
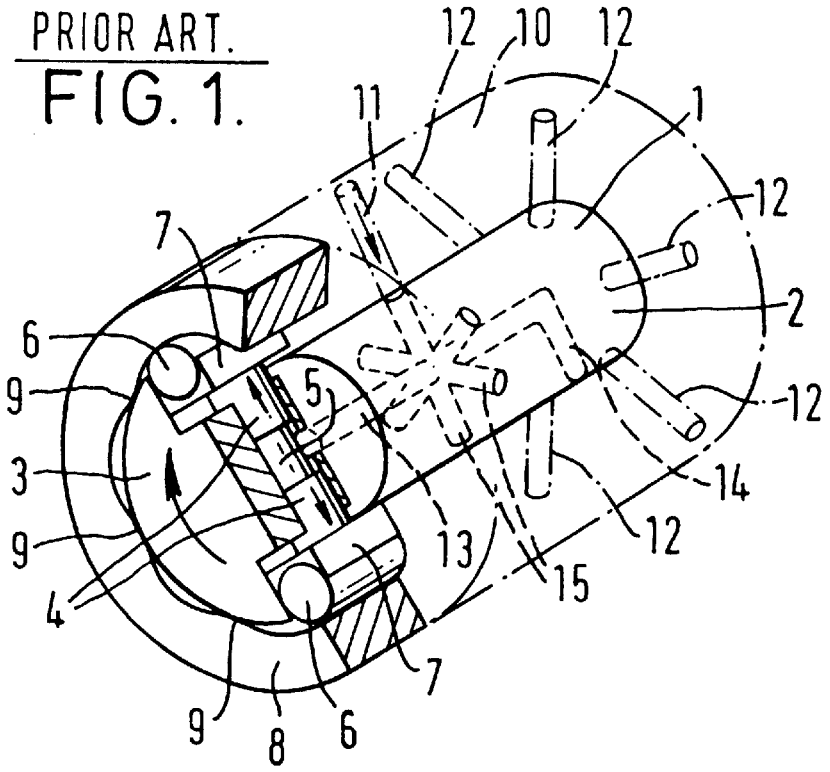
PRIOR ART. FIG. 1.
FIGS. 1 and 2 are a perspective diagrammatic views of a pumping unit at the core of a known rotary fuel injection pump.
Figure 2:
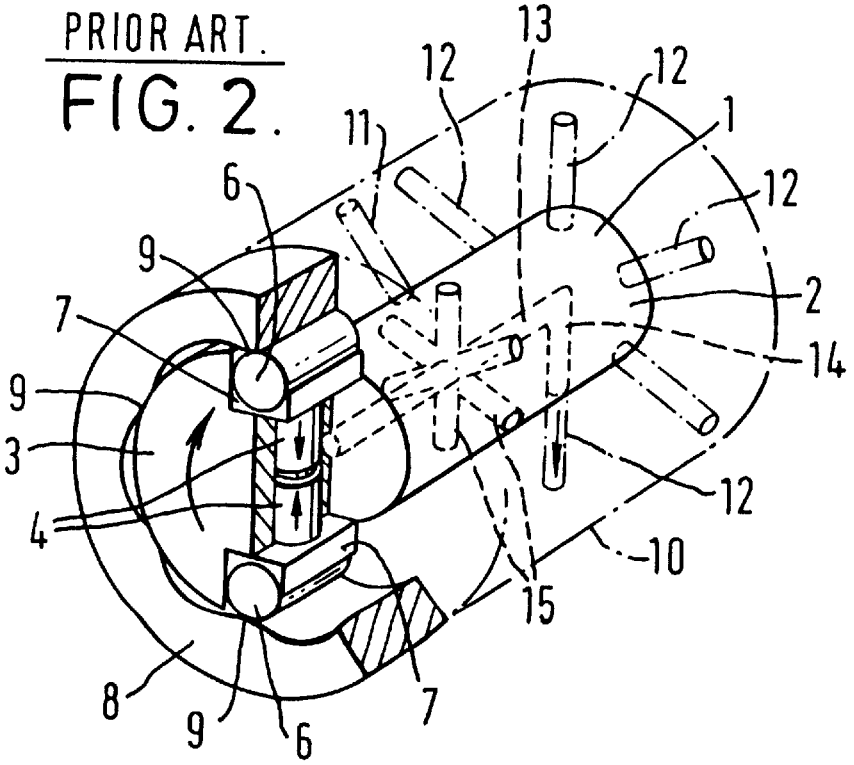
PRIOR ART. FIG. 2.
Figure 3:
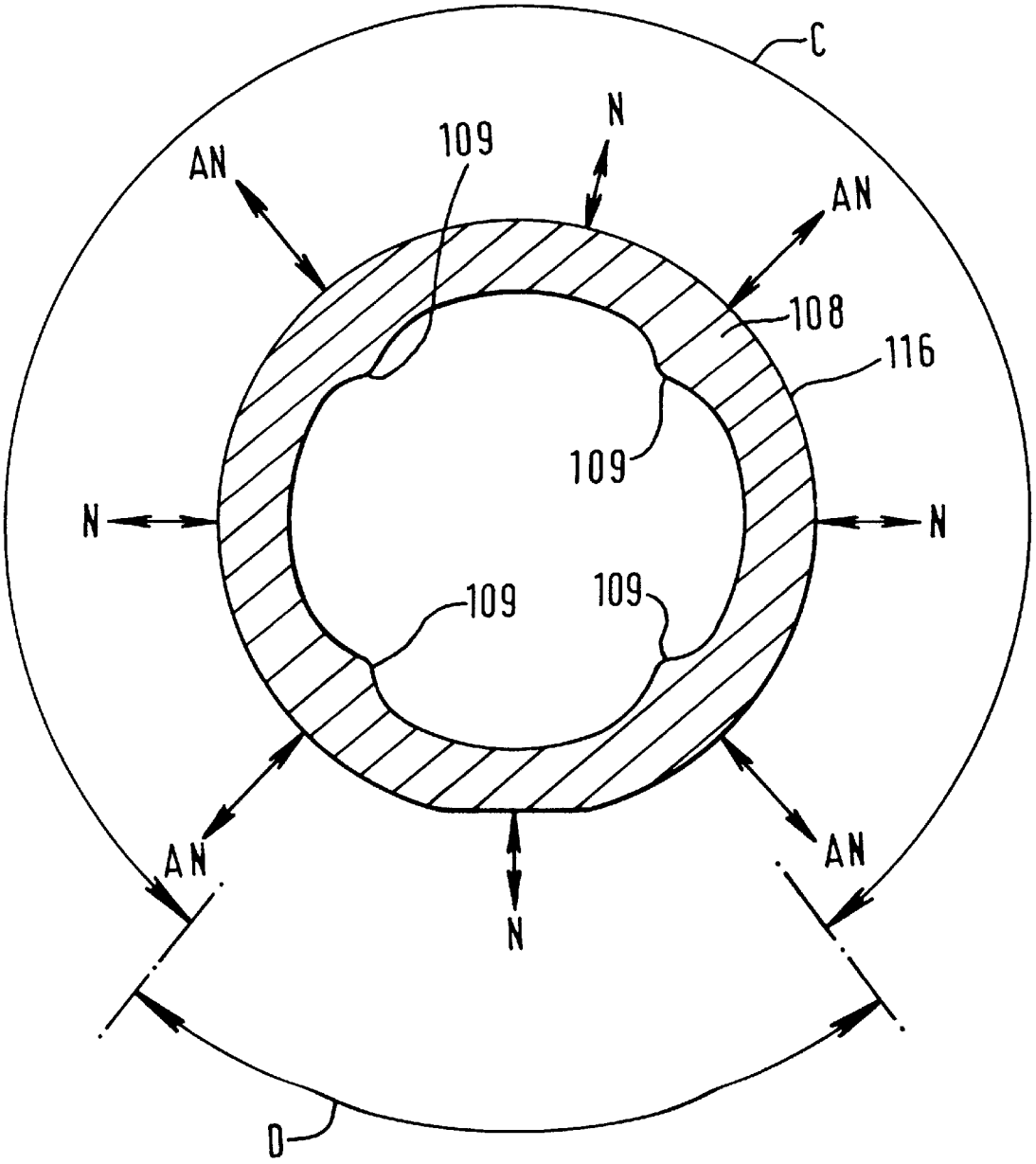
PRIOR ART. FIG. 3.
FIG. 3 is a cross-sectional view of a known cam ring of such a rotary fuel injection pump.
Figure 4:
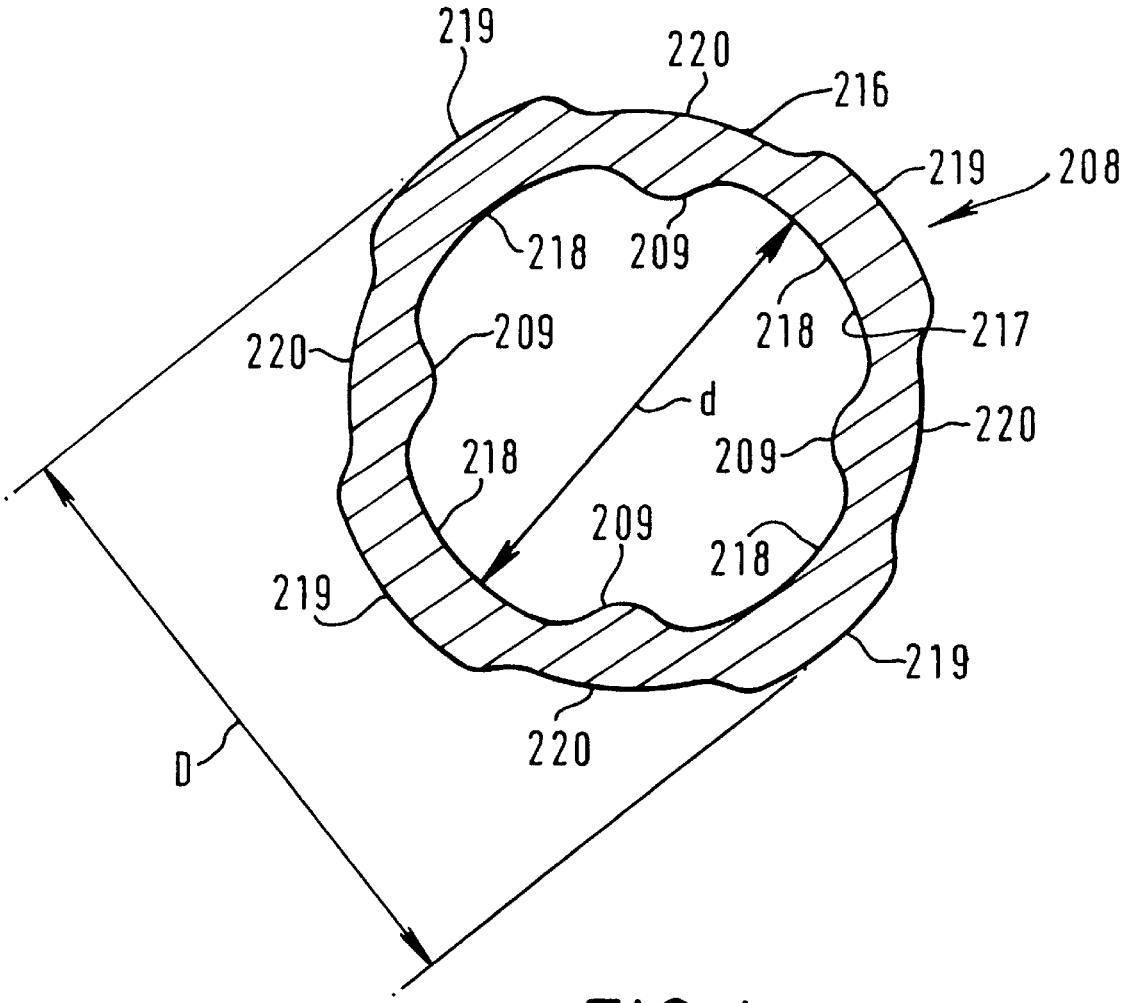
FIG. 4 is a cross-sectional view of a cam ring in accordance with a first embodiment of the present invention.

The cam ring 208 of FIG. 4 has an annular inner surface 217 which faces radially inwards and is substantially the same as on the prior art cam ring 108 of FIG. 3.

Thus, the annular inner surface 217 has cam lobes 209 which are separated by troughs 218.

The annular outer surface 216 has along its length a series of peaks 219 and a series of depressions 220 located between the peaks 219.

It may be seen that each of the depressions 220 is radially outwards from and radially aligned with a respective one of the cam lobes 209.

The troughs 218 lie on and have the same curvature as a notional cam circle of diameter d.

Each peak 219 has a curved top which has the same curvature as and lies on a notional interface circle of diameter D.

The circumferential lengths of the peaks 219 are decided by consideration of the mechanical design constraints relating to the required support of the cam ring by the pump body.

In use, the cam ring 208 is received in an aperture of a pump body and the aperture has a completely or partly annular side wall which interfaces with the peaks 219 of the cam ring 208. As already explained, the aperture may be such that the side wall is interrupted by a slot which contains a retard and advance mechanism for the cam ring. The resulting interface between the pump body and the cam ring is a complete or partial annulus as already discussed in relation to FIG. 3. The side wall of the aperture of the pump body lies on the notional interface circle of diameter D so that the side wall abuts against the cam ring and thus supports the cam ring via the peaks 219. Localised separations, in the form of empty cavities, exist along the interface, between the side wall of the aperture of the pump body and the depressions 220. Thus, the antinodes of the vibrational mode which exist at the depressions 220 are free to vibrate in the cavities contained in the depressions 220 and there is comparatively little mechanical coupling of vibration from the cam ring 208 to the pump body.

As a result, the rotary pump is less noisy than the prior art rotary pump.

It is the geometry of the cam ring which dictates where the antinodes will be and where the nodes will be and thus where the localised separations between the cam ring and the pump body across the supporting interface need to be provided. Generally speaking, nodes are likely to occur at the troughs 218 and antinodes are likely to occur at the cam lobes 209.

The length, shape and depth of the depressions 220 may be arrived at by considering the particular characteristics of the pump installation, material characteristics, anticipated amplitudes of vibration at the antinodes, the need to avoid binding of the cam ring to the pump body, minimising wear and erosion at the interface between the cam ring and the pump body and other factors.

Figure 5:
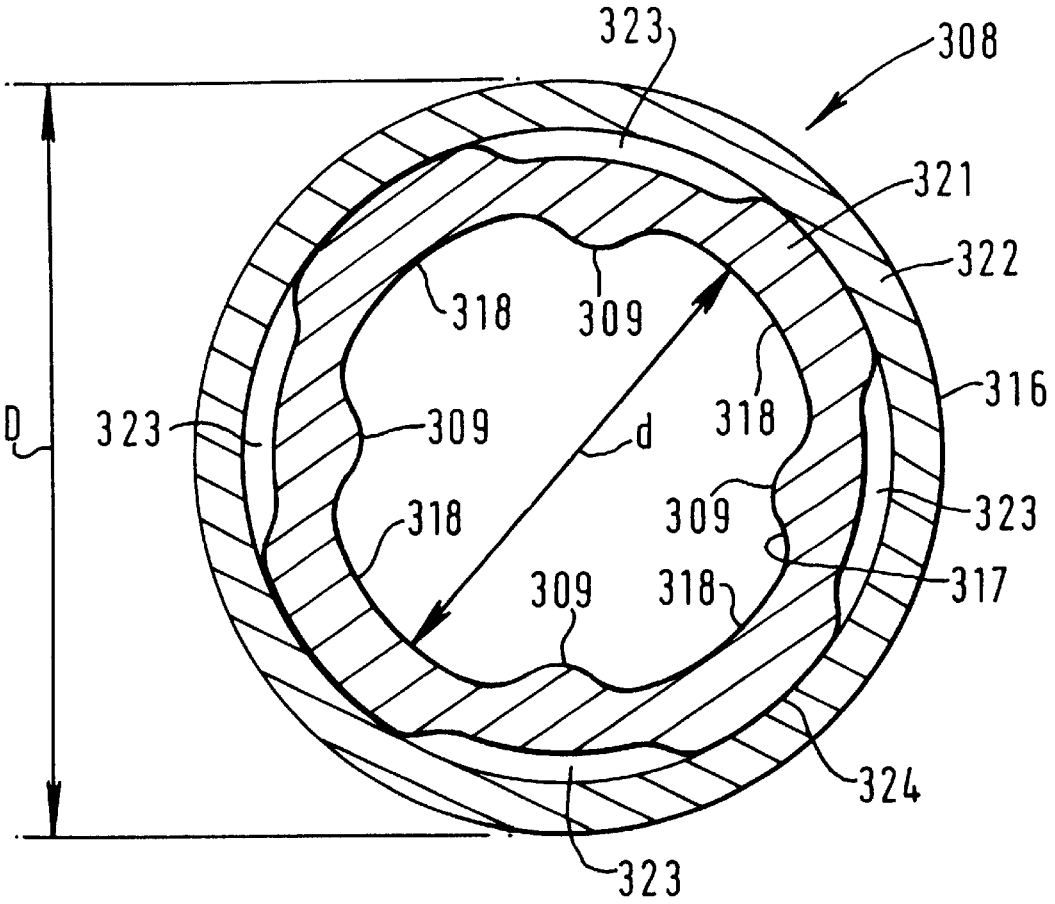
FIG. 5 is a cross-sectional view of a cam ring in accordance with a second embodiment of the present invention.

The second embodiment of FIG. 5 differs from the first embodiment of FIG. 4 in the following ways.

The cam ring 308 comprises inner and outer component rings 321, 322 and the annular outer surface 316 is circular. The cavities 323 are formed as gaps in the annular joint 324 between the component rings 321, 322 and are radially aligned with the cam lobes 309 so as to be at the vibrational antinodes.

The outer component ring 322 may be a shrink fit onto the inner component ring 321.

The cavities 323 are empty in this embodiment but may be injection filled with a vibration deadening material in order to increase the vibrational decoupling of the cam lobes 309 from the pump body.

What is claimed is:

1. A rotary pump comprising:

a pump body;

a rotor rotatably supported by the pump body and responsive to mechanical pulses to pump a fluid; and a stator ring supported by the pump body and having a ring of projections arranged to deliver mechanical pulses to the rotor when the rotor rotates relative to the stator ring;

wherein;

the stator ring has a vibrational mode which is induced by delivering the mechanical pulses to the rotor;

the pump body supports the stator ring across an interface which is a complete annulus or a partial annulus; and at the interface, and/or in the stator ring, there are cavities positioned at the antinodes of the vibrational mode of the stator ring so as to reduce the vibrational transmission from the stator ring to the pump body across the interface and wherein the interface comprises a first surface of the stator ring and a second surface of the pump body;

the second surface lies on a notional interface circle;

the first surface has along its length a series of peaks and a series of depressions located between the peaks; and the peaks lie on the notional interface circle so as to abut the second surface, whereby the stator ring is supported by the pump body, and the depressions extend away from the notional interface circle so as to form the cavities at the interface.

2. A rotary pump according to claim 1, wherein the cavities are empty of any solid material.

3. A rotary pump according to claim 1, wherein the antinodes of the vibrational mode are positioned, circumferentially of the stator ring, at the projections of the stator ring, and the cavities are positioned at the same circumferential positions as the projections.

4. A rotary pump according to claim 1, wherein the stator ring is a cam ring which has an annular inner surface which faces radially inwards and includes a series of cam lobes which function as the ring of projections for delivering the mechanical pulses to the rotor when the rotor rotates relative to the cam ring.

5. A rotary pump according to claim 4, wherein:

the interface comprises a first surface of the cam ring and a second surface of the pump body;

the first surface of the cam ring is part or all of the length of an annular outer surface of the cam ring;

the annular outer surface faces radially outwards;

the second surface lies on a notional interface circle;

the first surface has along its length a series of peaks and a series of depressions located between the peaks;

the peaks lie on the notional interface circle so as to abut the second surface, whereby the cam ring is supported by the pump body, and the depressions extend radially inwardly of the cam ring and away from the notional interface circle so as to form the cavities at the interface;

the antinodes of the vibrational mode are positioned, circumferentially of the cam ring, at the lobes of the cam ring; and the depressions of the first surface are radially aligned with the cam lobes.

6. A rotary pump according to claim 5, wherein each peak has a curved top which has the same curvature as the notional interface circle.

7. A rotary pump according to claim 5, wherein:

the pump body has an aperture in which the cam ring is received and is rotationally adjustable;

the aperture defines the second surface and is interrupted by a slot which contains an adjustment mechanism for rotationally adjusting the cam ring in the aperture; and the adjustment mechanism is connected to the cam ring at one of the nodes of the vibrational mode of the cam ring.

8. A rotary pump according to claim 1, wherein the stator ring comprises a roller ring which has an end which includes a series of axially-projecting rollers which function as the ring of projections for delivering the mechanical pulses to a cam plate of the rotor when the rotor rotates relative to the roller ring.

9. A rotary pump comprising:

a pump body;

a rotor rotatably supported by the pump body and responsive to mechanical pulses to pump a fluid; and a stator ring supported by the pump body and having a ring of projections arranged to deliver mechanical pulses to the rotor when the rotor rotates relative to the stator ring;

wherein:

the stator ring has a vibrational mode which is induced by delivering the mechanical pulses to the rotor;

the pump body supports the stator ring across an interface which is a complete annulus or a partial annulus; and at the interface, and/or in the stator ring, there are cavities positioned at the antinodes of the vibrational mode of the stator ring so as to reduce the vibrational transmission from the stator ring to the pump body across the interface and wherein the stator ring comprises inner and outer component rings which are rigidly fixed together and the cavities are formed as gaps in the annular joint between the component rings.

10. A rotary pump according to claim 9, wherein the cavities are empty of any solid material.

11. A rotary pump according to claim 9, wherein the antinodes of the vibrational mode are positioned, circumferentially of the stator ring, at the projections of the stator ring, and the cavities are positioned at the same circumferential positions as the projections.

12. A rotary pump according to claim 9, wherein the stator ring is a cam ring which has an annular inner surface which faces radially inwards and includes a series of cam lobes which function as the ring of projections for delivering the mechanical pulses to the rotor when the rotor rotates relative to the cam ring.

13. A cam ring for a rot wherein:

the cam ring has an annular inner surface which faces radially inwards and includes a ring of cam lobes for driving pump plungers of a pump rotor;

the cam ring has an annular outer surface which faces radially outwards and has, along part or all of its length, a series of peaks and a series of depressions located between the peaks; and each depression is radially aligned with a respective one of the cam lobes wherein each peak has a curved top which lies on a notional circle common to all of the curved tops of the peaks and has the same curvature as the notional circle.

14. A cam ring according to claim 13, wherein there are "n" peaks and at least "n−1" depressions, "n" is an integer greater than or equal to three and each depression is located between a respective successive pair of the peaks.

15. A cam ring according to claim 14, wherein "n" is 3, 4, 5, 6 or 8.

16. A cam ring according to claim 14, wherein the number of depressions is one less than the number of peaks.

17. A cam ring according to claim 14, wherein the number of depressions is the same as the number of peaks.

18. A cam ring for a rotary pump, wherein:

the cam ring comprises inner and outer component rings which are rigidly fixed together:

the inner component ring has an annular inner surface which faces radially inwards and includes a ring of cam lobes for driving pump plungers of a pump rotor; and at least one cavity is present in an annular joint between the component rings.

19. A cam ring according to claim 18, wherein each cavity is radially aligned with a respective one of the cam lobes.

20. A cam ring according to claim 18, wherein the number of cavities is the same as the number of cam lobes.

21. A cam ring according to claim 18, wherein the number of cam lobes is 3, 4, 5, 6 or 8.

* * * * *